United States Patent [19]

Voytko

[11] 4,046,311

[45] Sept. 6, 1977

[54] RETURN MAIL CONTAINER

[75] Inventor: Joseph Voytko, Lakewood, Ohio

[73] Assignee: Westvaco Corporation, New York, N.Y.

[21] Appl. No.: 705,774

[22] Filed: July 16, 1976

[51] Int. Cl.[2] ..... B65D 5/10

[52] U.S. Cl. ..... 229/40; 229/87 A; 229/39 R

[58] Field of Search ..... 229/40, 87 A, 39 R, 229/45 R, 73

[56] References Cited

U.S. PATENT DOCUMENTS

| | | | |
|---|---|---|---|
| 1,195,492 | 8/1916 | Moore | 229/73 |
| 1,615,200 | 1/1927 | Shrum | 229/40 |
| 1,852,527 | 4/1932 | King | 229/39 R UX |
| 2,011,703 | 8/1935 | Barker | 229/87 A |
| 2,024,832 | 12/1935 | Myers | 229/40 |
| 3,451,535 | 6/1969 | Caplan | 229/39 R X |

FOREIGN PATENT DOCUMENTS

| | | | |
|---|---|---|---|
| 79,300 | 10/1962 | France | 229/40 |

*Primary Examiner*—Davis T. Moorhead

[57] ABSTRACT

The return mail container of the present invention is formed from a one-piece blank of paperboard or the like and comprises a mailing address flap and a return address flap each of which has an integral locking tab attached to a free end thereof and a locking tab receiving slot located along the opposed end edge thereof. The container is used for mailing by folding the mailing address flap over the return address flap and inserting the locking tab attached thereto into the tab receiving slot in the return address flap. For returning, the return address flap is folded over the mailing address flap and the locking tab attached thereto is inserted into the tab receiving slot in the mailing address flap.

1 Claim, 8 Drawing Figures

RETURN MAIL CONTAINER

BACKGROUND OF INVENTION

The present invention relates to the field of packaging and more particularly, it relates to a shipping container for mailing material back and forth between two addresses.

Mailing containers are well known in the art and are used both for single delivery to a named addressee, and for two way delivery between the addressee and addressor. However, under the general conditions experienced during handling by the Postal Offices, the containers are often subjected to damage. Thus mailing containers must be generally durable for single delivery, but they must be especially durable for two way mail use. Further, mailing containers should also be economical to manufacture, easy to load and close, simple to open and provide a secure closing scheme to guard against inadvertent opening.

The mailing container of the present invention satisfies all of the above needs and further provides a practical and expedient package for return mail use.

DESCRIPTION OF THE PRIOR ART

Of the known mailing containers in the prior art, all do not have a return mail capability, thus the following list of United States patents are not limited thereto, but they are believed to represent exemplary designs for both single delivery and for two way delivery:

U.S. Pat. No. 2,970,742
U.S. Pat. No. 3,140,812
U.S. Pat. No. 3,219,256
U.S. Pat. No. 3,355,087
U.S. Pat. No. 3,386,642

Each of the containers disclosed in the above noted patents could probably be used for two way mailing even if not specifically described for that purpose. However, only U.S. Pat. No. 3,355,087 in the above list specifically discloses a return mail capability. In contrast to the mailing container of the latter mentioned patent, it will be seen that the container of the present invention provides a more secure and tamperproof locking mechanism and a generally more rugged construction.

SUMMARY OF INVENTION

A return mail container for packaging generally rectangular objects is formed from a single blank of corrugated paperboard or the like and includes a plurality of side walls and top closure flaps. The top closure flaps are arranged in two pairs and are located at the free edges of side walls connected to a generally quadrilateral main panel. The top closure flaps which are initially folded over a packaged object in a first folding step are of substantially the same shape and are dimensioned so as to be no greater than one-half the width of the packaged object. The top closure flaps which are folded over a packaged object in the second and third folding steps are of full width, i.e., they completely cover the packaged object and are designated a mailing address flap and a return address flap. Each of the mailing address and return address flaps further include a locking tab and tab receiving slot arrangement which are selectively engaged to lock the container for mailing and return. Thus, the container is used for mailing by folding the mailing address flap over the return address flap and inserting the locking tab attached thereto into the tab receiving slot in the return address flap. Upon being received, the locking tab on the mailing address flap is severed to open the container. Subsequently, for return mail, the return address flap is folded over the mailing address flap and the remaining tab attached thereto is inserted into the tab receiving slot in the mailing address flap.

Accordingly it may be seen that the container of the present invention provides a handy and economical two way mailing package with a rugged construction and a means for providing a positive tamperproof lock.

DETAILED DESCRIPTION

Figure 1:
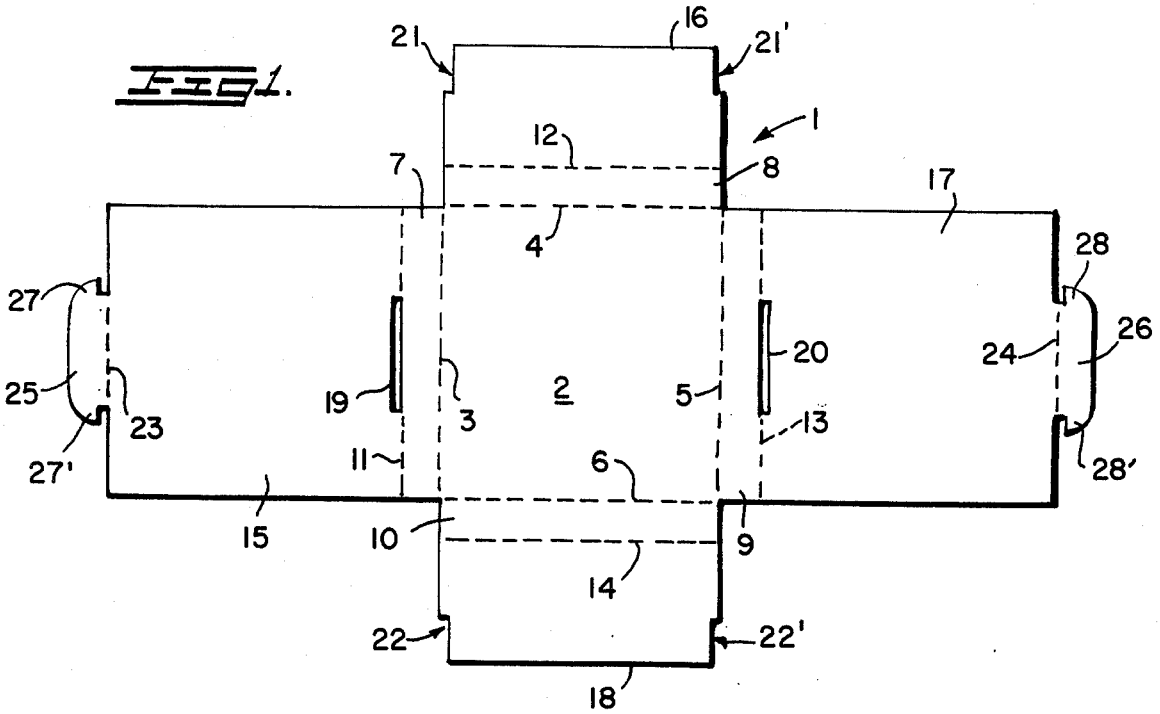
FIG. 1 is a plan view of a typical flat paperboard blank from which the container of the present invention is folded.

Referring now to the drawing in detail, and particularly to FIG. 1, there is shown a flat blank 1 of corrugated paperboard material which is scored and cut to form the different panels and flaps which make up the container of the present invention. Blank 1 includes a substantially quadilateral main panel 2 separated from a plurality of side walls 7–10 by scored fold lines 3–6. The side walls 7–10 are of substantially the same shape and dimensions for packaging a generally flat object of uniform thickness such as a reel of film, a book, a tape cassette or photographs, proofs and the like. Thus, in general, the container of the present invention is intended for packaging substantially rectangular objects, but obviously round objects, or objects having other shapes could also be successfully packaged in the container of the present invention as desired.

Further reference to FIG. 1 shown a plurality of top closure flaps 15–18 foldably attached to the free edges of side walls 7–10 along fold lines 11–14. For the sake of convenience of description, the top closure flaps are designated a first pair of top closure flaps 15, 17 and a second pair of top closure flaps 16, 18. The first pair of top closure flaps are further designated a mailing address flap 17 and a return address flap 15. The second pair of top closure flaps 16, 18 are preferably dimensioned to have substantially the same width as the attached side wall panels 8, 10 and to have a length so as not to overlap one another when folded over a packaged object. Thus, the length of flaps 16 and 18 may vary from a maximum of substantially equal to one-half the width of a first dimension of the packaged object to a minimum which will insure that the flaps will be retained under the second pair of top closure flaps in the finally folded and locked condition of the container.

Flaps 16 and 18 are also preferably provided with notched portions near their ends thereof as indicated by the notches 21, 21' and 22, 22' respectively. These notches ultimately provide spaces 29 and 30 as shown in FIG. 2 which accomodate the unused locking tab provided on one of the first pair of locking flaps 15 or 17.

The first pair of locking flaps 15, 17 are preferably dimensioned to have substantially the same width as the attached side wall panels 7, 9 and to have a length substantially equal to the width of a first dimension of the packaged object which permits the flaps to fully overlap one another and the enclosed packaged object. Each of the flaps 15, 17 further include one or more locking tabs foldably connected to the outer free edges thereof and one or more locking tab receiving slots located substantially along the fold lines connecting the flaps to the side wall panels. As shown in FIG. 1, a single pair of locking tabs 25, 26 are attached substantially centrally of the outer free edges of flaps 15 and 17 respectively along fold lines 23 and 24. Each of the tabs has a nominal width as defined by the length of the fold lines 23, 24 and further include locking ears 27, 27' and 28, 28' at each side thereof which ultimately are engaged behind the outer edges of the slots 19 and 20 which are also located substantially centrally of the flaps 15, 17 respectively adjacent the fold lines 11 and 13. Each of the slots 19, 20 are dimensioned to have a width that is substantially equal to the thickness of the material from which the blank is made and a length that is substantially equal to the nominal width of the tabs 25, 26. Thus, when the tab 25 or 26 on one flap is inserted in the tab receiving slot 20 or 19 on the opposite flap the locking ears 27, 27' or 28, 28' become engaged behind the outer edges of the respective slot to securely lock the container.

Figure 2:
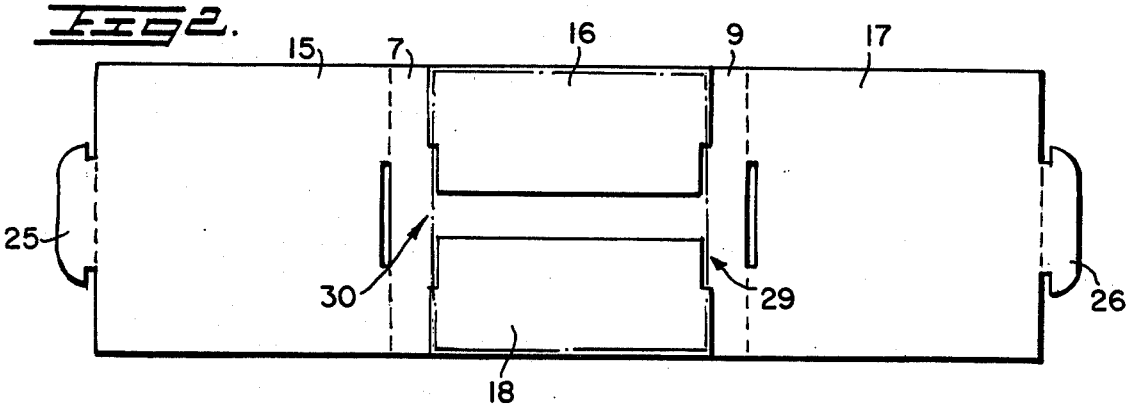
FIG. 2 is a plan view of the blank of FIG. 1 after the first folding step.

FIG. 2 shows the condition of blank 1 with the second pair of top closure flaps 16 and 18 folded over a rectangularly shaped object shown in phantom lines. In the condition shown in FIG. 2, the spaces 29, 30 provided by notched areas 21, 22 and 21', 22' are clearly illustrated. As stated hereinbefore, the flaps 16 and 18 must extend somewhat over the top of the packaged object but they preferably do not overlap. Likewise, the spaces 29 and 30 should be slightly oversized as compared with the overall width of tabs 25, 26 in order to accomodate the unused tab 25 or 26 depending upon whether the container is being mailed or returned.

Figure 3:
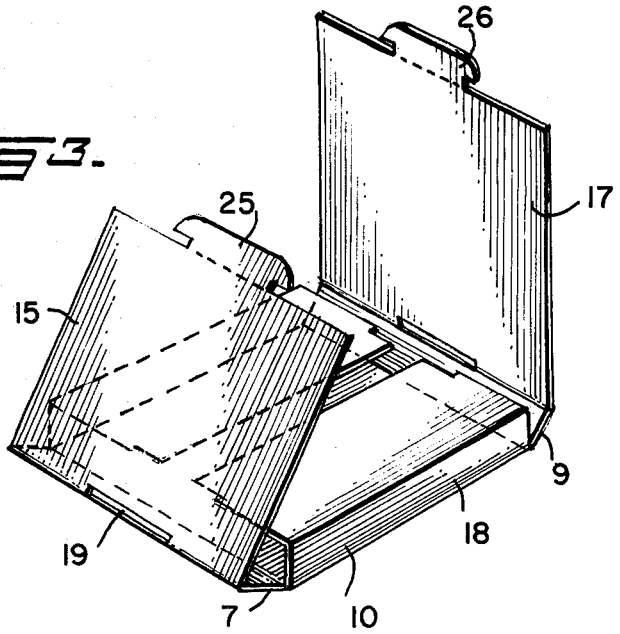
FIG. 3 is a perspective view showing the initiation of the second and third folding steps for mailing.
Figure 4:
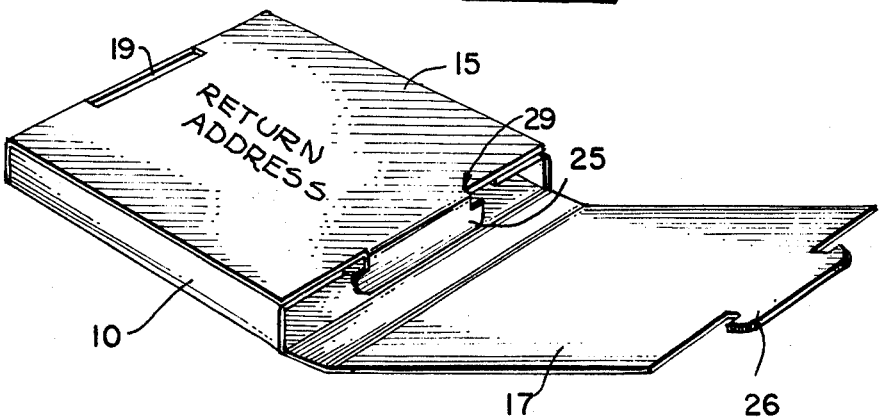
FIG. 4 is a perspective view showing the second folding step for mailing.
Figure 5:
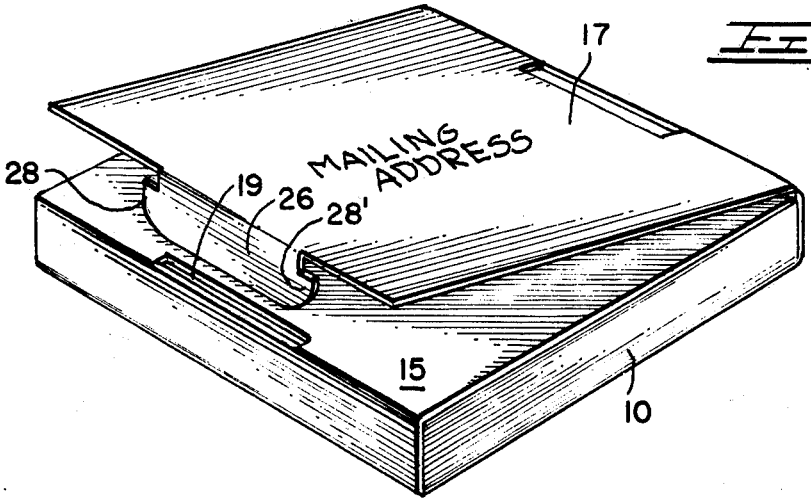
FIG. 5 is a perspective view showing the third folding step in preparing the container for mailing.

FIG. 3 illustrates the next folding sequence for closing a packaged object in the container. In this sequence, one of the flaps 15 or 17 is folded down first depending upon whether the container is being mailed or returned. FIG. 4 illustrates the return address flap 15 folded down over the flaps 16, 18 as the second folding step in preparing the container for mailing. In this instance, locking tab 25 is accomodated within the space 29 provided therefor while flap 17 is prepared for folding. FIG. 5 shows flap 17 almost completely folded down with tab 26 about to be inserted in slot 19. The container is finally locked into its tamperproof closed condition when the locking ears 28, 28' are fully inserted in slot 19 and locked behind the ends of the tab receiving slot.

Figure 6:
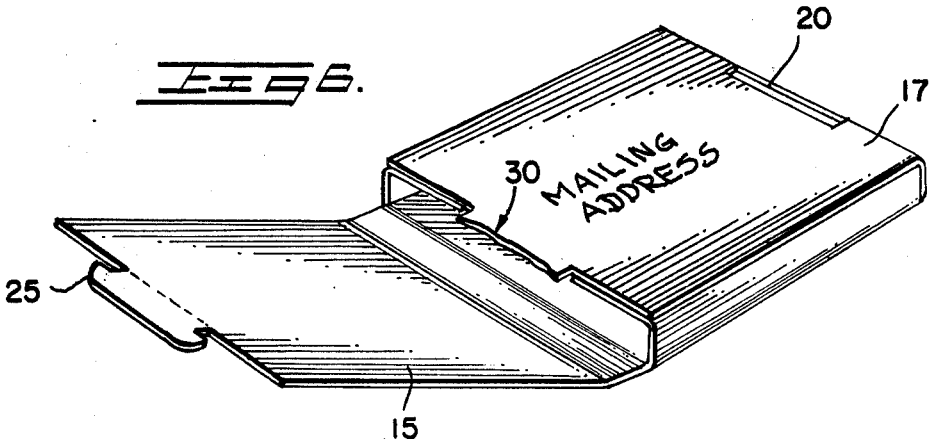
FIG. 6 is a perspective view showing the container in the second folding step for return.
Figure 7:
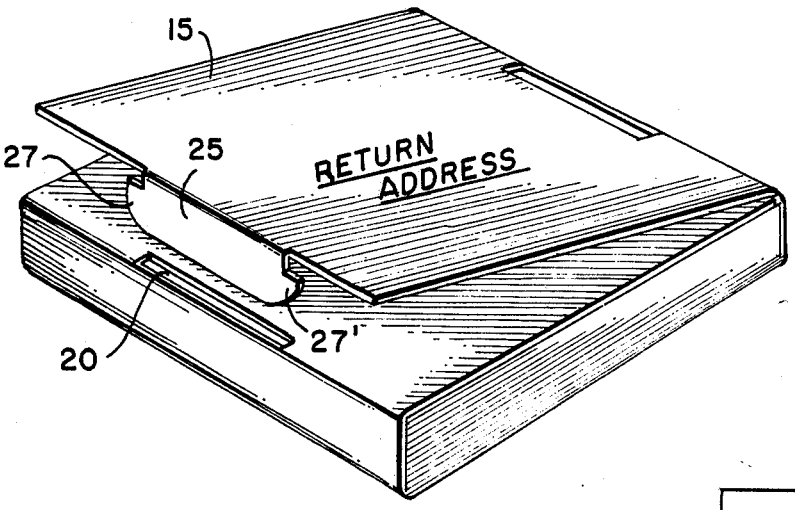
FIG. 7 is a perspective view showing the container in the third folding step in preparing the container for return; and, FIG. 8 is a partial plan view of an alternative flat paperboard blank from which the container of the present invention is folded.

When the container is received by the addressee, it is opened by severing tab 26 from the top closure flap 17. Later, when it is desired to repackage the object for return mail, the second and third steps are repeated in reverse fashion. As shown in FIG. 6, the second pair of top closure flaps 16, 18 are already folded over the packaged object for return mail, with flap 17 (the mailing address flap) folded thereover. In this condition, the partially severed tab 26 on flap 17 easily fits within the space 30 provided therefor. Subsequently, as shown in FIG. 7 the return address flap 15 is folded to overlie flap 17 and tab 25 on flap 15 is inserted in tab receiving slot 20 in flap 17. Thus, the container is completely closed for return mail by reversing the sequence for folding flaps 15 and 17.

Figure 8:
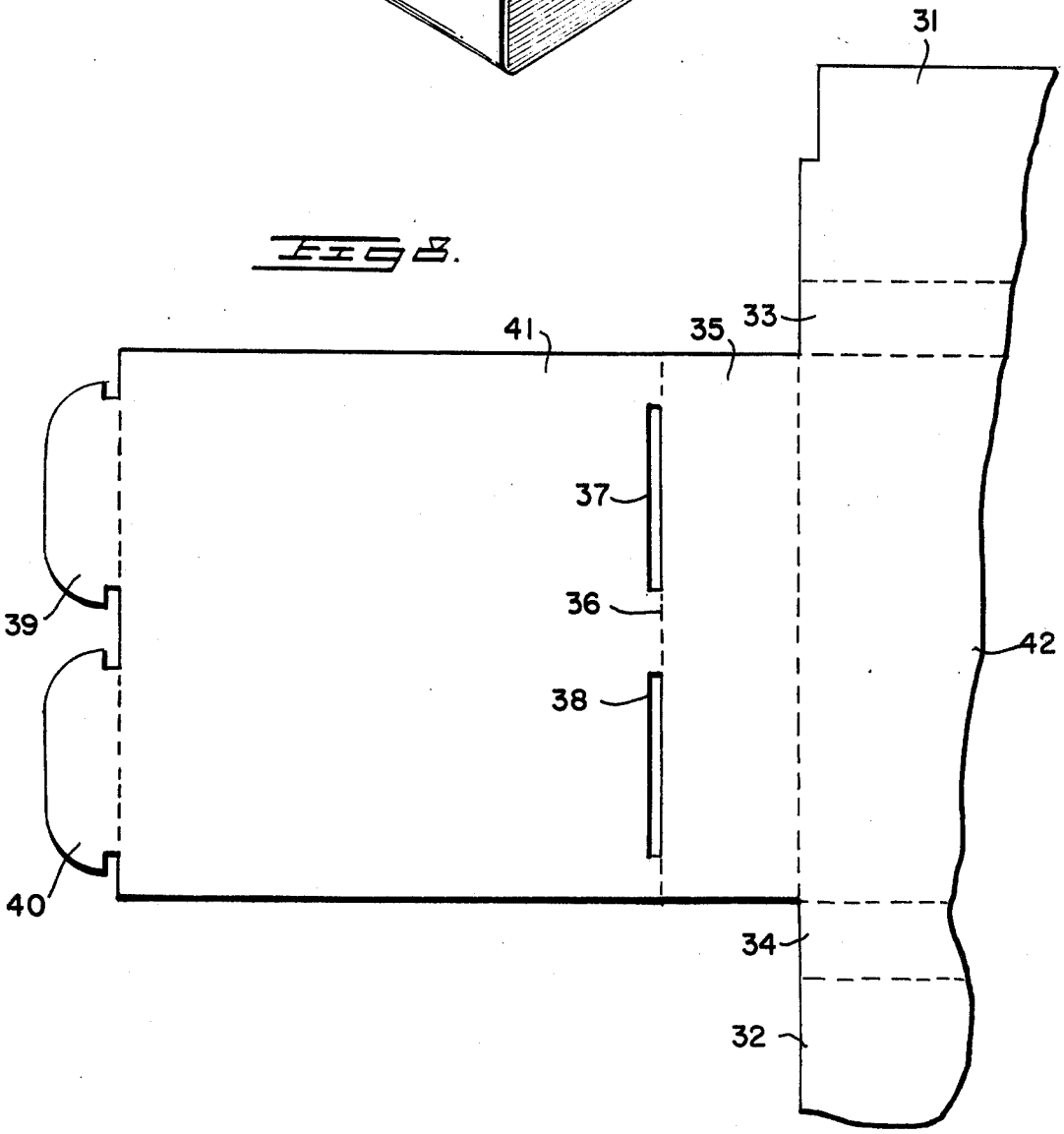

FIG. 8 is a partial plan view of a blank which uses more than one tab and slot arrangement for closing the container. Depending upon the size of the object being packaged, it is sometimes desirable to provide the additional locking tabs to achieve a satisfactory closure. Accordingly, the blank in FIG. 8 shows a main panel 42 flanked by a plurality of side wall panels 33, 34, 35 and a second pair of closure flaps 31, 32. Meanwhile, at another side of the blank there is shown one of a pair of first top closure flaps 41 which is separated from the side wall 35 by a fold line 36. The top closure flap 41 is also provided with a pair of locking tabs 39–40 and a pair of tab receiving slots 37, 38. Obviously, the other side of the blank would be similarly laid out so that the tabs on one flap are arranged to cooperate with the tab receiving slots on the opposite blank in a manner as disclosed for the blank of FIG. 1.

Accordingly, although a preferred embodiment of the container of this invention has been shown and described in detail, it is to be understood that numerous changes and variations can be made in the construction of the container without departing from the scope of the invention as defined in the appended claims.

I claim:

1. A tamperproof return mail container for packaging a generally flat object, formed from a one-piece blank of paperboard or the like comprising a centrally located quadrilateral main panel of substantially the same dimensions as the packaged object, a plurality of side wall panels foldably attached to the edges of said main panel, said side wall panels each having a width substantially equal to the width of its attached main panel edge and a length substantially equal to the height of the packaged object, a first pair of top closure flaps designated respectively a mailing address flap and a return address flap foldably attached to two opposed side wall panel, said first pair of top closure flaps each having a width substantially equal to the width of its attached side wall panel and a length substantially equal to the full size of the first dimension of the packaged object wherein said first pair of top closure flaps are adapted to alternately overlap one another to cover the packaged object, said first pair of top closure flaps each further including at least one locking tab foldably attached along an outer free edge thereof and at least one tab receiving slot located substantially along the foldable connection between said top closure flap and side wall and opposite the locking tab attached to the outer free edge thereof, wherein said locking tabs have a nominal width substantially equal to the length of the attached foldable connection with integral locking ears projecting from each side thereof, and said tab receiving slots each have a length substantially equal to the nomimal width of said locking tabs and a width substantially equal to the thickness of the blank material from which the container is formed, and a second pair of top closure flaps foldably attached to the remaining opposed side wall panels, said second pair of top closure flaps each having a width substantially equal to the width of its attached side wall panel and a length no greater than about one-half the size of a second dimension of the packaged object, said second pair of top closure flaps each including notched portions at each side thereof near their free ends for accomodating an unused locking tab, wherein the container is prepared for mailing when the return address flap is folded over the packaged object and second top closure flaps to place the unused locking tab thereon in the region provided by the notched portions at one side of said second top closure flaps, and the mailing address flap is folded over the return address flap and the locking tab attached thereto is inserted in the tab receiving slot of said return address flap so as to position the integral locking ears thereof beyond the ends of said tab receiving slot, and the container is prepared for return mail, after severing the locking tab from the mailing address flap to open the container, with a reverse folding sequence wherein the return address flap is folded over the mailing address flap and the locking tab attached thereto is locked in the tab receiving slot of said mailing address flap.

* * * * *